United States Patent [19]

Focke et al.

[11] Patent Number: 4,742,955

[45] Date of Patent: May 10, 1988

[54] FLIP-TOP PACKET, PARTICULARLY FOR CIGARETTES

[75] Inventors: Jürgen Focke; Kurt Liedtke, both of Verden, Fed. Rep. of Germany

[73] Assignee: Focke & Co. (GmbH & Co.), Verden, Fed. Rep. of Germany

[21] Appl. No.: 8,497

[22] Filed: Jan. 29, 1987

[30] Foreign Application Priority Data

Feb. 3, 1986 [DE] Fed. Rep. of Germany ..... 3603213

[51] Int. Cl.[4] ..... B65D 5/66

[52] U.S. Cl. ..... 229/123; 206/268; 206/273; 229/16 A; 229/160.1

[58] Field of Search ..... 229/16 A, 44 CB, 123, 229/160.1; 206/268, 270, 271, 273

[56] References Cited

U.S. PATENT DOCUMENTS 2,176,912 10/1939 Luckett ..... 206/273
2,865,498 12/1958 Ringler ..... 206/268
4,121,756 10/1978 Focke et al. ..... 229/16 A

FOREIGN PATENT DOCUMENTS 447445 3/1948 Canada ..... 229/44 CB
654558 12/1962 Canada ..... 229/44 CB

*Primary Examiner*—Stephen Marcus
*Assistant Examiner*—Gary E. Elkins
*Attorney, Agent, or Firm*—Sughrue, Mion, Zinn, Macpeak & Seas

[57] ABSTRACT

For the easier removal of the contents, particularly of cigarettes (32), of a flip-top packet, fold lines are pre-shaped (central fold line 33, continuation fold lines 35, 36) in the region of a front wall (13) and of a collar front wall (29) in a manner such that by application of pressure via side walls (21) the front wall (13) with the collar front wall, when the flip-top packet is open, are brought into a position which is V-shaped in cross-section.

6 Claims, 6 Drawing Sheets

FLIP-TOP PACKET, PARTICULARLY FOR CIGARETTES

DESCRIPTION

Figure 1:
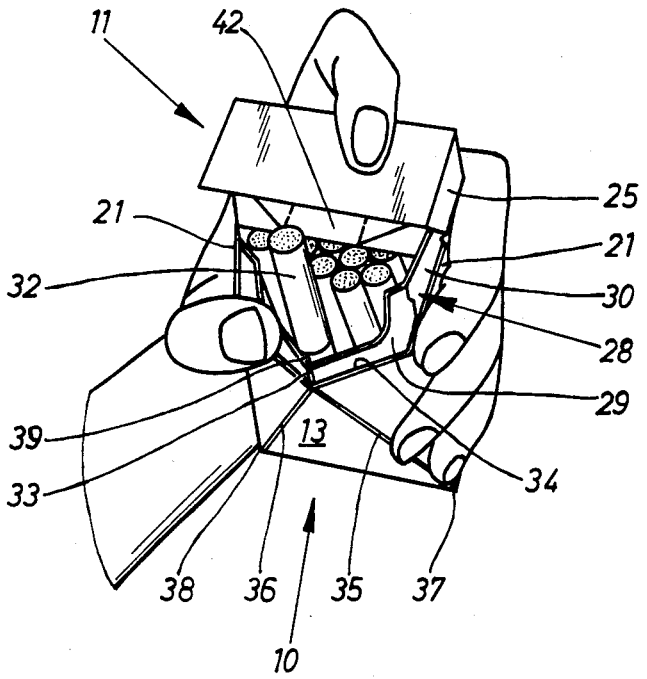

The invention relates to a flip-top packet, particularly for cigarettes, consisting of a packet having a front wall, rear wall and side walls, a hinged lid pivotably adjoining the rear wall, and a collar which partly projects out of the packet in the region of the front wall and of the side walls and is surrounded by the hinged lid in the closed position.

The type of pack claimed is frequently also called a hinged-lid pack, and is primarily used as a packaging for cigarettes. A thin card is used as packaging material, so that the flip-top packet as a whole has a relatively high intrinsic rigidity.

Since the group of cigarettes—wrapped in an internal blank (tin toil blank)—exactly fills the interior space of the flip-top packet, removal of the cigarettes when the flip-top packet is open is not very easy. In particular it is difficult to grasp with two fingers opposite sides of a cigarette to be removed, while the flip-top packet is still largely full.

On this basis, the object of the invention is to develop a flip-top packet of the initially mentioned or modified type in such a way that easier handling when removing cigarettes is made possible.

In order to achieve this object the flip-top packet according to the invention is characterized in that the collar and the front wall of the packet are provided, at least in the upper region facing the collar with pre-shaped stampings in a manner such that the collar and the front wall are deformable outwards from the side walls, forming an enlarged removal aperture for the contents of the pack.

In the case of the invention, while the original dimensional stability of the flip-top packet is retained, simple means are used to create possibilities of deforming the front wall of the packet and the collar or the front wall thereof by compressing the flip-top packet, in such a way that an extended aperture is formed which is funnel-shaped or V-shaped in cross-section. The position of the cigarettes relative to one another is thus altered, in such a way that easy removal is possible by lateral gripping. As a result of the V-shaped deformability of the front wall including the collar, one cigarette in each case passes into the region of the groove formed approximately in the centre. Removal is facilitated here by the extensive exposure of the cigarette.

In the preferred embodiment of the flip-top packet according to the invention the collar or a collar front wall is provided with an upright, central fold line stamped into the packaging material (central fold line). This is continued in the region of the front wall of the packet in the form of continuation fold lines which branch in a V-shaped manner and extend to the bottom corners of the flip-top packet. The overall pattern of the pre-shaped or pre-stamped fold lines makes possible the special opening position of the front wall and collar which facilitates the removal of cigarettes.

An advantageous development of the flip-top packet according to the invention envisages the arrangement of a push-in tab on the hinged lid. The arrangement of the push-in tab on the hinged lid is particularly advantageous in connection with the outwardly deformable front wall of the packet and of the collar. When the flip-top packet is closed the push-in tab passes between the front wall of the packet and the corresponding section of the collar front wall. As a result the fliptop packet can always be reliably and permanently closed again even after relatively frequent opening, the push-in tab being retained by frictional fit between the corresponding region of the front wall and of the collar front wall.

Further features of the invention relate to the design of the fold lines and of the push-in tab and to the application thereof to blanks for the collar and the packet.

Figure 3:
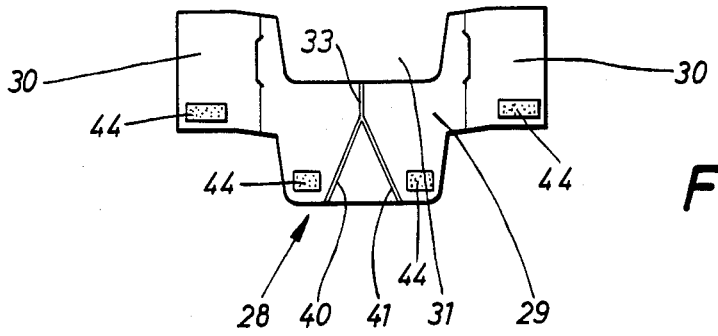
Figure 2:
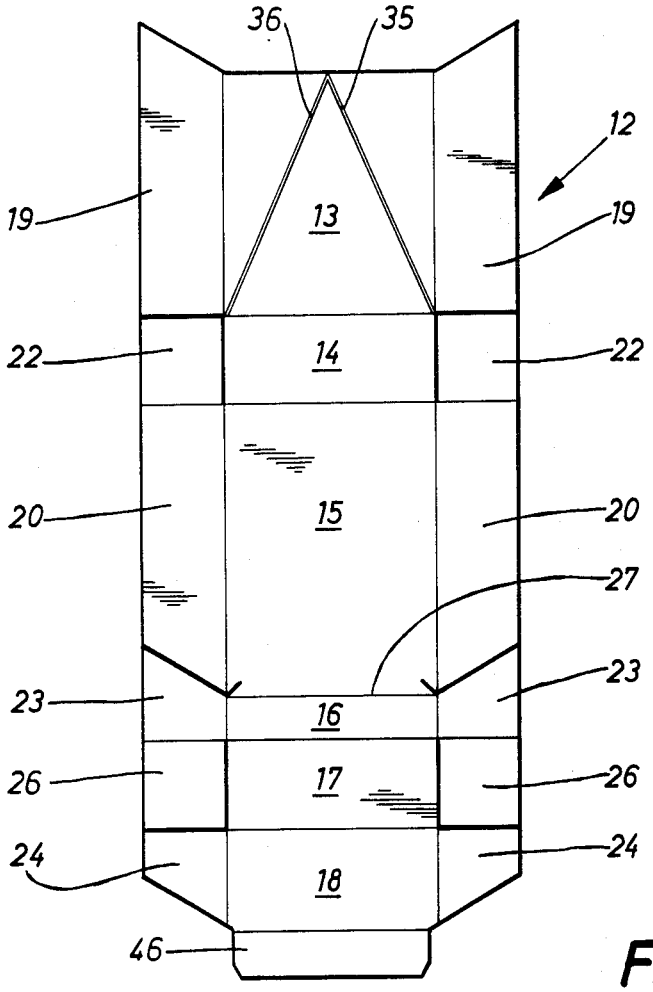
Figure 6:
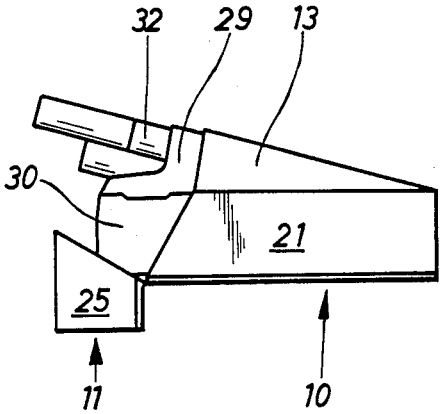
Figure 7:
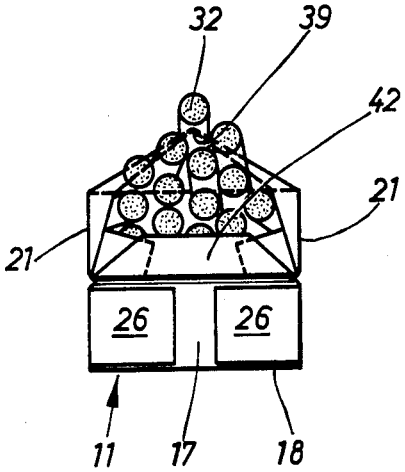
Figure 5:
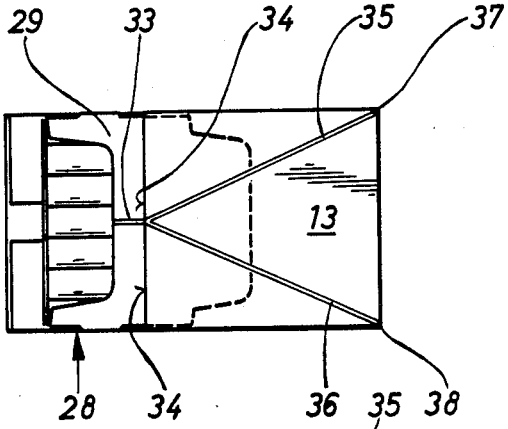
Figure 4:
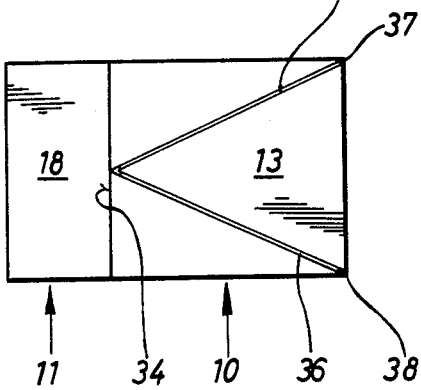
Figure 8:
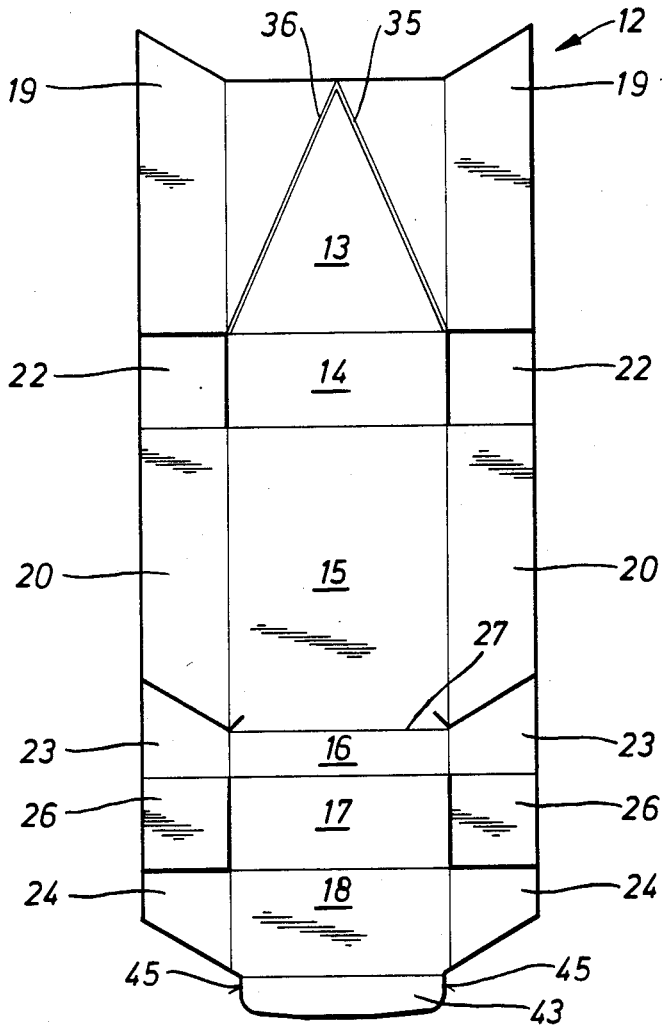
Figure 9:
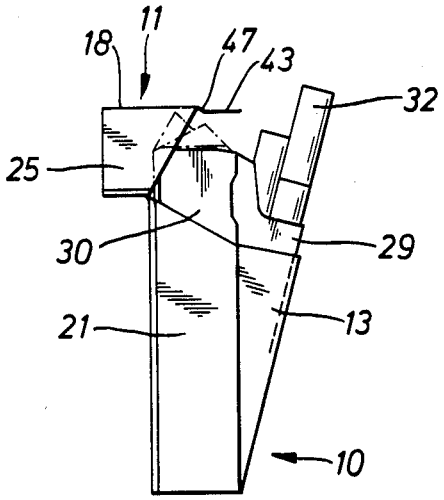
Figure 10:
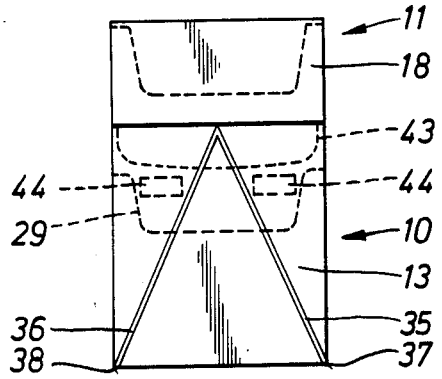
Figure 11:
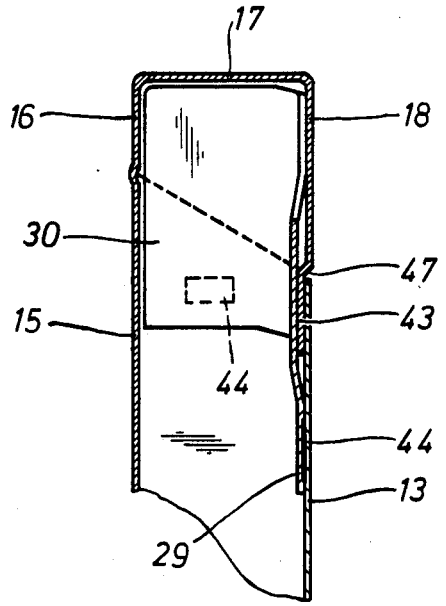

Two exemplary embodiments of the invention are explained in detail below, with reference to the drawings, in which:

FIG. 1 shows a flip-top packet in the open position for the removal of cigarettes, in the perspective view, FIG. 2 shows a blank for a flip-top packet according to FIG. 1 in the spread-out position, FIG. 3 shows a blank for a collar of a flip-top packet, similarly in the spread-out position, FIG. 4 shows the flip-top packet with fold lines in the region of the front wall, in a front view, FIG. 5 shows the flip-top packet according to FIG. 4 in the open position, similarly in a front view, FIG. 6 shows the opened flip-top packet with the front wall deformed for the removal of cigarettes, in a lateral view, FIG. 7 shows the flip-top packet in the position according to FIG. 6 seen from above, FIG. 8 shows a blank for a second embodiment, in the spread-out position, FIG. 9 shows the opened flip-top packet made from the blank according to FIG. 8 with the front wall deformed for the removal of cigarettes, in a lateral view, FIG. 10 shows the closed flip-top packet of FIG. 9 in a front view, and FIG. 11 shows the upper region of the closed flip-top packet of FIG. 10 in vertical cross-section, seen on a larger scale.

The present flip-top packet has a structure which is in principle conventional. It consists of a packet 10 and a hinged lid 11 articulated thereto. A blank 12 for the flip-top packet consists conventionally of thin card or another suitable packaging material. Because of the design of the blank, the flip-top packet is produced by the "lateral closure" principle. For this purpose consecutive regions are formed within the blank 12 for a front wall 13, a bottom wall 14, a rear wall 15, a lid rear wall 16, a lid top wall 17 and a lid front wall 18. Side flaps 19 are connected laterally in the region of the front wall 13 and, together with side flaps 20 in the region of the rear wall 15 form double-layered side walls 21 of the packet 10. Bottom corner flaps 22 adjoin the side flaps 20 adjacent to the bottom wall 14, and rest on the inside of the bottom wall 14 in the completed pack.

Lid side flaps 23 and 24 are present in a corresponding manner in the region of the lid rear wall 16 and in the region of the lid front wall 18, and form doublelayered lid side walls 25. In addition, an inner flap 46 is connected to the lid front wall 18 and is folded against the inside of the lid front wall 18 in the embodiment of FIGS. 1 to 7. A lid corner flap 26 is connected to the (inner) lid side flaps 23 and is folded against the inside of the lid top wall 17 in the completed pack. The lid rear wall 16 is connected via a hinge fold line 27 with the rear wall 15 of the packet 10.

The complete flip-top packet includes a collar 28. The blank for the collar (FIG. 3) consists of a collar front wall 29 and collar side walls 30. The collar 28 is inserted into the packet 10 in such a manner that a lower part of the collar front wall 29 rests internally on the front wall 13 and a lower part of the collar side walls 30 rests internally on the side walls 21 or the inner side flaps 19. The collar 28 is connected to the packet by means of adhesive. The part of the collar 28 which projects out of the packet is enclosed, in the closed position, by the lid front wall 18 and lid side walls 25. The collar is conventionally shaped so that a recess 31 is formed in the region of the collar front wall 29.

For easier removal of the contents of the flip-top packet, namely of cigarettes 32, the collar, namely the collar front wall 29, and the front wall 13 of the packet 10 are designed in a special manner, namely by means of pre-stamped or pre-shaped fold lines which permit a deformation of the front wall 13 and collar 28 when the flip-top packet is opened, namely when the hinged lid 11 is swung back, so as to widen a removal aperture. For this purpose, in the exemplary embodiment shown, the collar front wall 29 is provided with an upright fold line, a central fold line 33, approximately in its centre. This extends over a region which corresponds to the part of the collar front wall 29 projecting out of the packet 10, leading in other words to a top edge 34 of the front wall 13.

The pattern of the fold lines continues from this point with obliquely aligned continuation fold lines 35 and 36 which thus extend towards one another in the manner of a roof. These connect directly with the lower end of the central fold line 33 and extend to lower front corners 37 and 38 of the front wall 13.

As a result of this special pattern of fold lines in the region of the collar front wall 29 and the front wall 13, the opened flip-top packet can be handled in a particular manner. As can be seen from FIG. 1, the hinged lid 11 is held in the open position by the index finger. The packet 10 is compressed from the side walls 21 with the thumb and remaining fingers, so that, in cross section or horizontal section, the front wall 13 and the collar front wall 29 form an approximately V-shaped dent. This produces an enlargement or restructuring of the removal aperture. A cigarette 32 from a front row of cigarettes passes into an approximately central groove 39 formed by the folding. Here the cigarette 32 has a particularly favourable position for gripping on both sides.

After the cigarettes have been removed and the side walls 21 of the packet 10 released, the front wall 13 and the collar front wall 29 substantially resume their original form. When the hinged lid 11 is brought into the closed position, the flip-top packet assumes a substantially cuboid form.

The fold lines 33, 35 and 36 are applied during the production of blanks 12 and of the collar 28, being pre-stamped, pre-shaped or produced by cross-sectional weakening. The deformation takes place from the inside of the blank 12 or of the collar 28. As a result a slight deformation of the packaging material towards the outside takes place, which facilitates the later deformation procedure to widen the removal aperture.

As can be seen from FIG. 3, the collar 28 and the collar front wall 29 are provided with supplementary fold lines 40, 41, which are connected to the lower end of the central fold line 33 and are arranged and designed in such a manner that they lie flush with the continuation fold lines 35 and 36 of the front wall 13 when the collar 28 is incorporated.

FIGS. 9 to 11 show a flip-top packet having a particularly effective re-closure. For this purpose, as FIG. 9 shows, a push-in tab 43, which in contrast to the inner flap 46 shown in FIG. 2 is not folded against the inside of the lid front wall 18, is arranged on the lid front wall 18. As a result, according to what is shown in FIG. 11, the push-in tab 43 projects, when the flip-top packet is closed, into an intermediate space formed between the front wall 13 of the packet 10 and the collar front wall 29 of the collar 28.

In the blank according to FIG. 8, the push-in tab 43 consists of a part-region adjoining the lid front wall 18 and having tab edges 45 extending parallel to one another and an end region with rounded-off edges which tapers in the manner of a tongue. Alternatively the push-in tab 43 may also possess a design corresponding to the inner flap 46 shown in FIG. 2. The distance between the opposing, parallel tab edges 45 is selected so that it is slightly less than the clear interior dimension of the packet 10 between its opposing side walls 21. Preferably the width of the push-in tab 43 between the tab edges 45 is 2/10 to 3/10 mm less than the clear internal dimension of the packet 10.

The collar 28 is advantageously attached to the packet 10 by means of adhesive, in such a manner that no adhesive joint is present in that region between the front wall 13 of the packet 10 and the collar 28 into which the push-in tab 43 enters. Preferably the collar 28 is stuck in the packet 10 by means of four adhesive spots 44 shown in FIG. 3. Of these, two of the adhesive spots 44 are allocated to the collar side walls 30 whereas the other two adhesive spots 44 are located on the collar front wall 29, in a manner such that when the flip-top packet is closed they rest at a slight distance below the push-in tab 43 (FIG. 10).

It can further be seen from FIGS. 9 and 11 that the push-in tab 43 is offset backwards relative to the lid front wall 18, by approximately the thickness of the front wall 13 of the packet, by means of a right-angled bend 47. The right-angled bend 47 is situated (extending horizontally) at the transition from the lid front wall 18 to the push-in tab 43.

In flip-top packets according to the exemplary embodiments shown the group of cigarettes is conventionally wrapped in a tin foil blank 42 which possesses a flap in the upper, front region. This flap is removed by pulling off in order for the flip-top packet to be used, so that the cigarettes are exposed in the front, upper region. When the front wall 13 with the collar 28 is deformed in the manner described, the front part of the tin foil blank 42 also shows this deformation.

The flip-top packets described above can be produced and filled in a conventional manner.

We claim:

1. A flip-top cigarette packet made of cardboard and having a front wall, rear wall and side walls, a hinged lid pivotably adjoining the top of the rear wall, and a collar which partly projects upwardly out of the packet in an upper region of the front wall and of the side walls and which is surrounded by the hinged lid in the closed position of the packet, said packet characterized:

in that a front wall (29) of the collar (28) has a central vertical fold line (33);

in that two continuation fold lines (35, 36) in the packet front wall (13) respectively extend from the bottom end of the vertical fold line (33) at the top edge (34) of the front wall (13) to bottom corners (37, 38) of the front wall (13) of the packet (10);

in that supplementary fold lines (40, 41) in the collar front wall (29) adjoin the bottom end of the vertical fold line (33) and extend toward the bottom corners (37, 38) in alignment with the continuation fold lines (35, 36) of the packet front wall (13);

in that all of the fold lines (33; 35, 36; 40 41) are preshaped grooves on the inside of the packet front wall (13) and collar front wall (29); and in that fold lines are formed only in said packet front wall (13) and said collar front wall (29), said packet rear wall (15) and said hinged lid being free of fold lines, whereby squeezing pressure applied to said side walls causes only said packet front wall (13) and said collar front wall (29) to be outwardly deformed to form an enlarged approximately V-shaped opening to facilitate removal of a cigarette from a full packet, and whereby the packet returns to an un-deformed state upon release of the squeezing pressure.

2. Flip-top packet according to claim 1, characterized in that a push-in tab (43) is arranged on the hinged lid (11) for localized insertion between the front wall (13) of the packet (10) and the collar front wall (29) of the collar (28).

3. Flip-top packet according to claim 2, characterized in that the push-in tab (43) is a tongue-like widening of a lid front wall (18) of the hinged lid (11).

4. Flip-top packet according to claim 2, characterized in that the collar (28) is connected to the packet (10), outside the region of insertion of the push-in tab (43) between the collar front wall (29) and the front wall (13) of the packet (10), by appropriate adhesive spots (44).

5. Flip-top packet according to claim 3, characterized in that the push-in tab (43) possesses tab edges (45) which extend parallel to one another at least in a partial region bordering the lid front wall (18).

6. Flip-top packet according to claim 5, characterized in that the push-in tab (43) possesses, in the region of the parallel tab edges (45), a width which is 2/10 to 3/10 mm less than the clear internal measurement of the packet (10) between its opposing side walls (21).

* * * * *